US007717152B2

(12) United States Patent
Moriya et al.

(10) Patent No.: US 7,717,152 B2
(45) Date of Patent: May 18, 2010

(54) NET GUIDE FOR WIRE SCREEN AND WIRE SCREEN APPARATUS HAVING THE SAME

(75) Inventors: Takashi Moriya, Suginami-ku (JP); Hirofumi Moriya, Suginami-ku (JP)

(73) Assignee: Seiki Sogyo Co., Ltd., Tokyo (JP)

( * ) Notice: Subject to any disclaimer, the term of this patent is extended or adjusted under 35 U.S.C. 154(b) by 243 days.

(21) Appl. No.: 11/576,850

(22) PCT Filed: Oct. 7, 2004

(86) PCT No.: PCT/JP2004/014858

§ 371 (c)(1),
(2), (4) Date: Apr. 6, 2007

(87) PCT Pub. No.: WO2006/038301

PCT Pub. Date: Apr. 13, 2006

(65) Prior Publication Data

US 2008/0053629 A1 Mar. 6, 2008

(51) Int. Cl.
*E06B 9/40* (2006.01)

(52) U.S. Cl. ..... 160/31; 160/84.06

(58) Field of Classification Search ..... 160/31, 160/23.1, 84.06, 98, 265, 273.1, 272, 271
See application file for complete search history.

(56) References Cited

U.S. PATENT DOCUMENTS 5,377,737 A * 1/1995 Moriya et al. ..... 160/84.06
6,186,212 B1 * 2/2001 Tsuchida ..... 160/84.06
6,318,438 B1 * 11/2001 Uno et al. ..... 160/31
6,978,820 B2 * 12/2005 Aoki ..... 160/84.06
7,472,738 B2 * 1/2009 Kamosawa et al. ..... 160/84.06
7,487,816 B2 * 2/2009 Moriya et al. ..... 160/31

FOREIGN PATENT DOCUMENTS

| | | |
|---|---|---|
| JP | 6 158961 | 6/1994 |
| JP | 9 4346 | 1/1997 |
| JP | 3222724 | 10/2001 |
| JP | 2002 371776 | 12/2002 |
| JP | 2003 201796 | 7/2003 |
| JP | 2004 3204 | 1/2004 |
| JP | 2004 346578 | 12/2004 |

* cited by examiner

*Primary Examiner*—David Purol
(74) *Attorney, Agent, or Firm*—Oblon, Spivak, McClelland, Maier & Neustadt, L.L.P.

(57) ABSTRACT

A net guide for a wire screen, made to absorb an impact by causing connections of many guide pieces of a net guide formed by the connections of the guide pieces to have a stretchability. A net guide going in and out from a lower end of a movable frame in compliance with an opening/closing of a net to thereby guide a lower end of the net is constituted by connecting, by a wire, many guide pieces formed approximately like a U-letter by a bottom part and a standing wall part. The wire is inserted through through-holes of the guide pieces, and the guide pieces under a connected state are pressed by a coil spring giving a tension to the wire.

15 Claims, 7 Drawing Sheets

NET GUIDE FOR WIRE SCREEN AND WIRE SCREEN APPARATUS HAVING THE SAME

TECHNICAL FIELD

The present invention is relating to a net guide used in a wire screen in which a net is made openable/closable by a lateral pull and, more concretely, is relating to a net guide for wire screen, which goes in and out from a lower end of at least one of a movable frame or a fixed frame, that is attached to both ends of the net, to and from its inside, and which is introduced out along a lower end of the net concerned under a stretched state to thereby guide that lower end.

BACKGROUND ART

In the wire screen in which the net is made openable/closable by the lateral pull, the net guide which goes in and out, in compliance with an opening-and-closing of the above net, from the lower end of the movable frame or the fixed frame, that is attached to both ends of the net, to and from its inside, and which is introduced out along the lower end of the net concerned under the stretched state to thereby guide that lower end, is hitherto publicly known as disclosed in Patent Document 1 or Patent Document 2 for instance.

The net guide described in the above Patent Document 1 is one which is constituted from plural resin-made guide pieces formed approximately like a U-letter by a bottom part along the lower end of the net and a standing wall part which stands up along an outer face of the net concerned, and a flexible tape-like member for connecting those guide pieces, and in which the guide pieces are connected by inserting the above tape-like member through an insertion part, of the above tape-like member, provided along bottom parts of the guide pieces, and fixing the guide pieces in both ends to the tape-like member concerned.

On the other hand, in the above Patent Document 2, there is disclosed one in which the above net guide is constituted as a connection-like body connected in order by a fitting between a protrusion and a hole in a rigid unit.

However, as to the net guides of the above Patent Documents 1 and 2, in both of them, since there is made such that the net guide can be bent in order to introduce it from the lower end of the movable frame or the fixed frame to its inside but cannot be bent in other direction, there has been an issue that if a foot or other thing is caught by the net guide introduced-out to a lower part of the net and a strong force or impact acts on it, the net guide is simply disassembled or damaged.

Patent Document 1: JP-A-2003-201796 Gazette
Patent Document 2: JP-A-2000-145314 Gazette

DISCLOSURE OF THE INVENTION

Problems that the Invention is to Solve

A problem of the invention is to solve the above issue, thereby providing a net guide for wire screen, in which there is no fact that it is simply disassembled or damaged even if the foot or other thing is caught by the net guide introduced-out to the lower part of the net and the strong force or impact acts on it.

Other problem of the invention is to provide a net guide for wire screen, in which there is made so as to cause the net guide, that is formed by connections of many guide pieces, to have a stretchability by which it can bend in some degree in an arbitrary direction.

Means for Solving the Problems

In order to solve the above problems, the invention is a net guide for wire screen, in which a movable frame is attached to one end of a net being made openable/closable by a lateral pull, in which a movable frame or a fixed frame is attached to the other end of the net, and which, in compliance with an opening/closing of the net by the lateral pull of the movable frame, goes in and out from an lower end of at least one of the movable frame or the fixed frame, that is attached to the end part of the net, to and from its inside, and which is introduced out along a lower end of the net under a stretched state to thereby guide that lower end, characterized in that the net guide possesses many guide pieces formed approximately like a U-letter by a bottom part along the lower end of the net a standing wall part which stands up along an outer face of the net, and a wire inserted through through-holes provided in the guide pieces to thereby connect these guide pieces, and in the wire there is additionally provided a spring means which spring-biases the guide pieces under a connected state in a mutually, closely contacting direction to thereby retain the many guide pieces to a linear connected state.

In a desirable implementation mode of the above net guide for wire screen, each of the guide pieces has a butt part butting mutually against the adjoining guide piece under a state in which the net guide is linearly introduced out along the lower end of the net under a stretched state, and the butt part is formed as a plane part being directed to a direction intersecting perpendicularly to a connection direction of the guide pieces.

Further, in the above net guide for wire screen, the wire inserted through the through-holes of the many guide pieces to thereby connect these guide pieces can be made a single wire, additionally it is made one in which the spring means possesses the coil spring, and a hollow cylindrical accommodation tube which accommodates the coil spring and whose length is longer than the coil spring, and one end of the wire is connected to the guide piece in one end of the net guide, the other end of the wire is connected to an introducing-out end side of the accommodation tube through the coil spring inserted into the accommodation tube, and a wire insertion end side of the accommodation tube is pressure-contacted with the guide piece of the net guide by a biasing force of the coil spring, or the spring means can be constituted by a stretchable wire elastically stretching/contracting, which is used in all or one part of the wire inserted through the through-holes of the guide pieces.

In the net guide for wire screen, which has the above constitution, since the many guide pieces constituting the net guide are connected by the wire and the wire is caused to always have a constant tension by the spring means, even if the strong force or impact acts on the net guide by the fact that the foot or other thing is caught by the net guide in introduced out in the lower part of the net, it is absorbed by a stretch of the spring means and the net guide bends in some degree in a direction of the acting force, so that there is no fact that it is simply disassembled or damaged.

Further, in the above net guide for wire screen, since the wire is inserted through the through-holes provided in the many guide pieces and connects them, there is no fact that, like the conventional net guide in which the rigid units are connected by the protrusion and the hole, a lot of trouble is required in an assembly, so that it is possible to easily manufacture the above net guide.

DESCRIPTION OF REFERENCE NUMERALS

Figure 1:
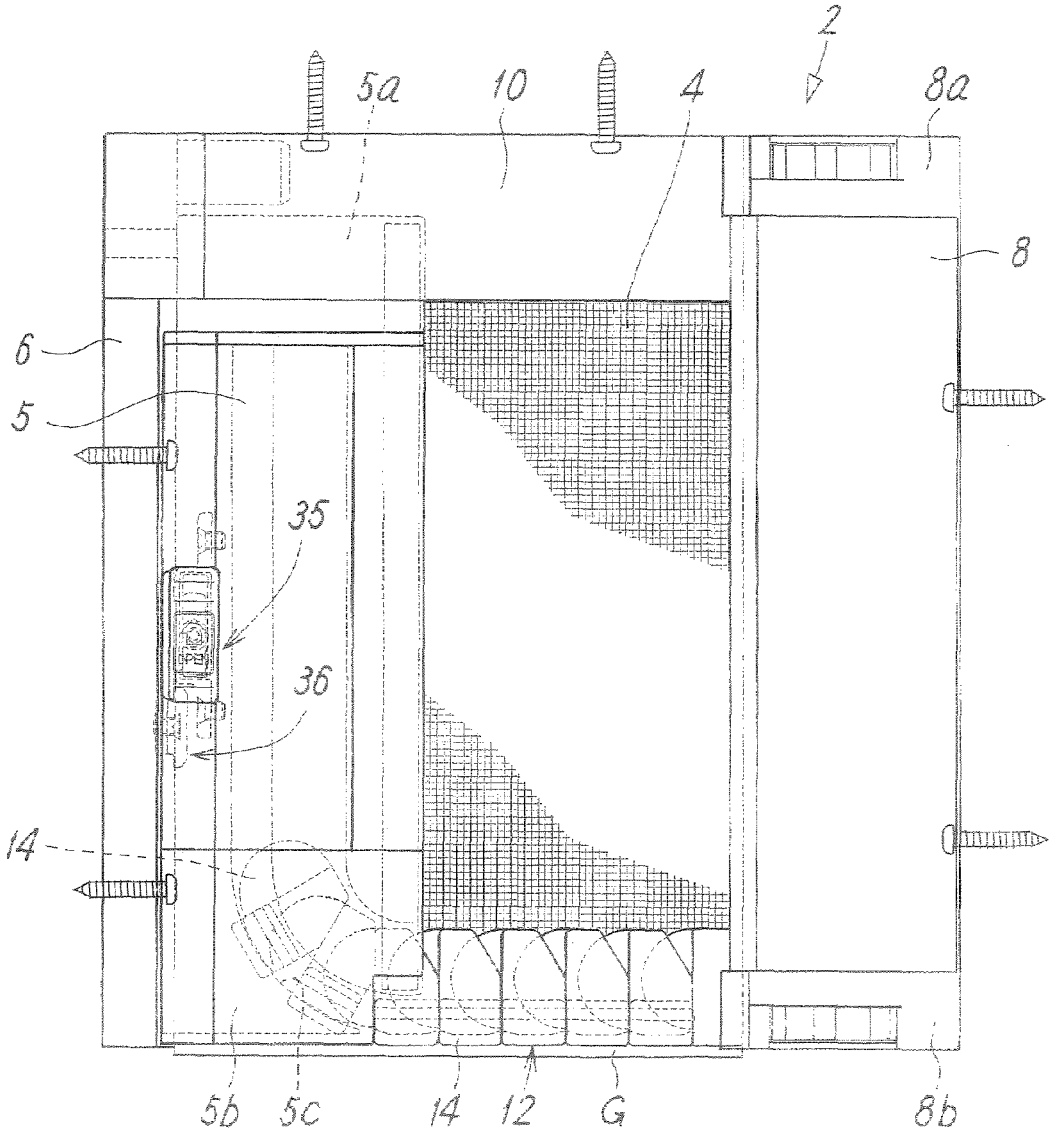
FIG. 1 It is a front view showing a constitution of a lateral pull mothproof wire screen in which a net guide for wire screen according to the invention is used.

2 wire screen frame
4 net
5 movable frame
6, 8 longitudinal frame member
10 lateral frame member
12, 22 net guide
14, 24 guide piece
14*a*, 24*a* bottom part
14*b*, 24*b* standing wall part
14*c*, 24*c* through-hole
15 wire
16, 26 spring means
17 coil spring
18, 28 accommodation tube

BEST MODE FOR CARRYING OUT THE INVENTION

Figure 2:
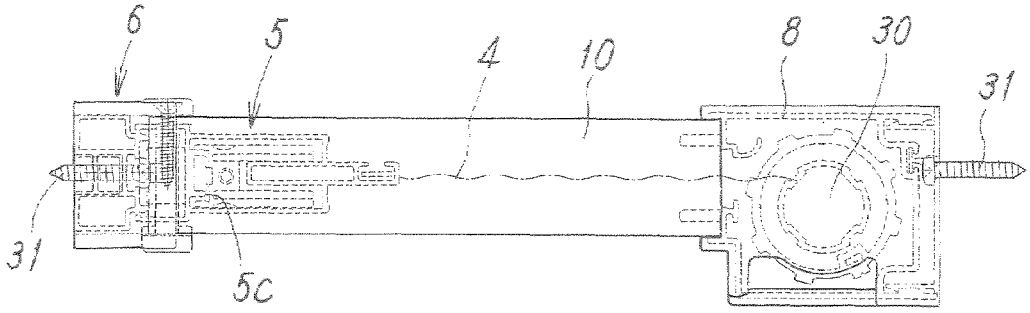
FIG. 2 It is a plan view of the same.
Figure 3:
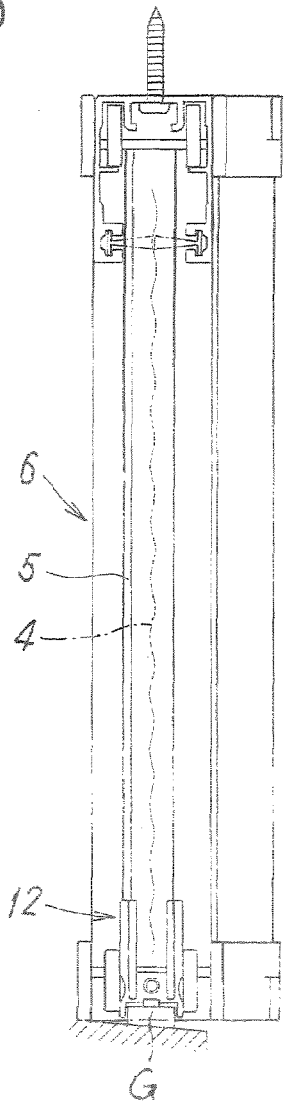
FIG. 3 It is a side sectional view of the same.

FIG. 1-FIG. 3 show one embodiment of a lateral pull mothproof wire screen in which a net guide for wire screen according to the invention is used.

As shown in FIG. 1, this wire screen possesses schematically a wire screen frame 2 installed in a building opening part, a mothproof net 4 attached in the wire screen frame 2 so as to be openable/closable by a lateral opening, and a movable frame 5 for an opening/closing operation, which is attached to one end of the net 4, and a net guide 12 for wire screen, according to the invention, is provided in a lower part of the wire screen frame 2.

Although the wire screen frame 2 has left/right longitudinal frame members 6, 8 and a lateral frame member 10, and one longitudinal frame member 8 of the longitudinal frame members 6, 8 is constituted by a fixed frame supporting a rotatable winding shaft 30 around which the net 4 is wound, there can be also made such that one longitudinal frame member 6 is made the fixed frame, one end of the net 4 is attached to the fixed frame, and the other end of the net 4 is wound around a winding shaft rotatably supported in the movable frame 5. Further, in the embodiment shown in the drawing, although there is made such that the net 4 is wound around the winding shaft 30, it is also possible to use one like an accordion by being alternatively folded back in reverse directions at a constant interval and, in this case, there can be made so as to be openable/closable in both left and right directions by attaching the movable frames to both ends of the net.

The longitudinal frame member 6 and a fixed frame constituting the longitudinal frame member 8 are ones fixed to a side frame (not shown in the drawing) of the building opening part by screws 31 and, to an upper end part and a lower end part of the fixed frame, there are attached respectively caps 8*a*, 8*b*.

There is constituted such that the winding shaft 30 builds in a coil spring (not shown in the drawing), and a rotation biasing force by a twist of this coil spring is made a drive source for the winding of the winding shaft 30 to thereby automatically wind the net 4, and there is made such that a lock device 35 provided in the movable frame 5 is engaged with a lock receiver 36 of the longitudinal frame member 6 at a stretched time of the net 4, and thus the net 4 can be retained in its stretched state. Further, upper ends of the net 4 and the movable frame 5 are guided by the lateral frame member 10.

As mentioned above, although the net guide 12 for wire screen is provided in the lower part of the wire screen frame 2, this net guide 12 is one in which its one end is fixed to a lower end of the fixed frame constituting the longitudinal frame member 8, it goes in and out to and from an inside of the movable frame 5 from its lower end in compliance with the opening/closing, of the net 4, following upon a movement of the movable frame 5 and, by the fact that it is introduced out along the lower end of the net 4 under its stretched state at the stretched time of the net 4, a swing of the lower end of the net 4 by the wind and the like is checked.

Further, frame caps 5*a*, 5*b* are attached respectively to an upper end part and a lower end part of the movable frame 5.

Figure 4:
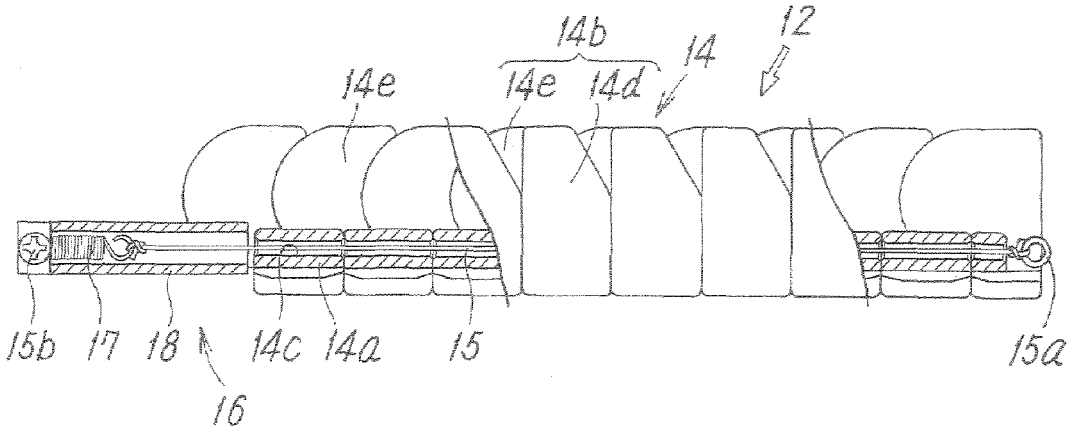
FIG. 4 It is a partially broken front view showing a first embodiment of the net guide for wire screen according to the invention.
Figure 5:
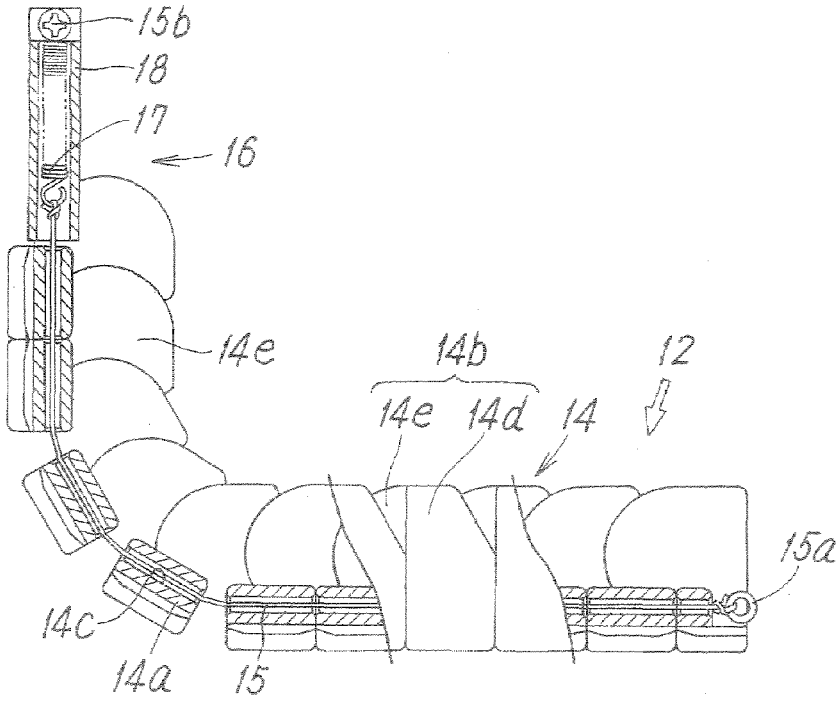
FIG. 5 It is a partially broken front view showing the net guide for wire screen under its bent state of the same.
Figure 6:
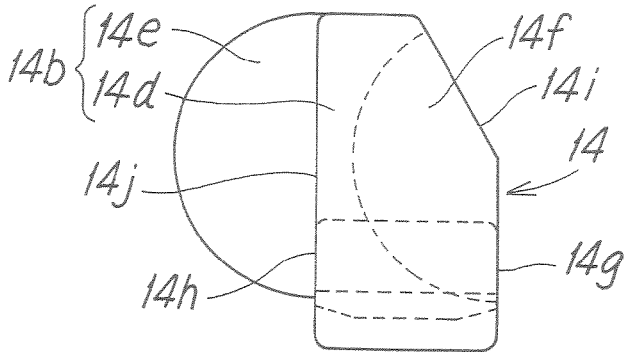
FIG. 6 It is a front view showing a constitution of a guide piece used in the net guide for wire screen of the same.

As shown in FIG. 4 and FIG. 5, the net guide 12 is constituted so as to be bendable by connecting many guide pieces 14, which are formed by an injection molding of a synthetic resin, by a single wire 15. Incidentally it is unnecessary that the guide piece is made of the synthetic resin.

If explained more concretely, as shown in FIG. 6-FIG. 9, the guide piece 14 constituting the net guide 12 is one formed approximately like a U-letter by a bottom part 14*a* along a lower end of the net 4 and one pair of standing wall parts 14*b* which stand up along an outer face of the net 4 and, in the bottom part 14*a* of this guide piece 14, there is provided a through-hole 14*c* for inserting the single wire 15 in a direction along the lower end of the net 4. The standing wall part 14*b* is constituted by a standing wall base part 14*d* vertically standing up from both sides of the bottom part 14*a*, and a semicircular standing wall convex part 14*e* monolithically protruding from one side of the standing wall base part 14*d* and, in an inside wall of the standing wall base part 14*d*, there is provided an escape part 14*f* for accommodating, when connecting the guide pieces 14, the semicircular standing wall convex part 14*e* of the adjoining guide piece 14.

Accordingly, by the fact that the semicircular standing wall convex part 14*e* is accommodated in the escape part 14*f*, the guide piece 14 is connected to the standing wall part 14*b* of the adjoining guide piece without an interstice and, moreover, it is possible to bend the net guide 12 upward concavely.

Figure 10:
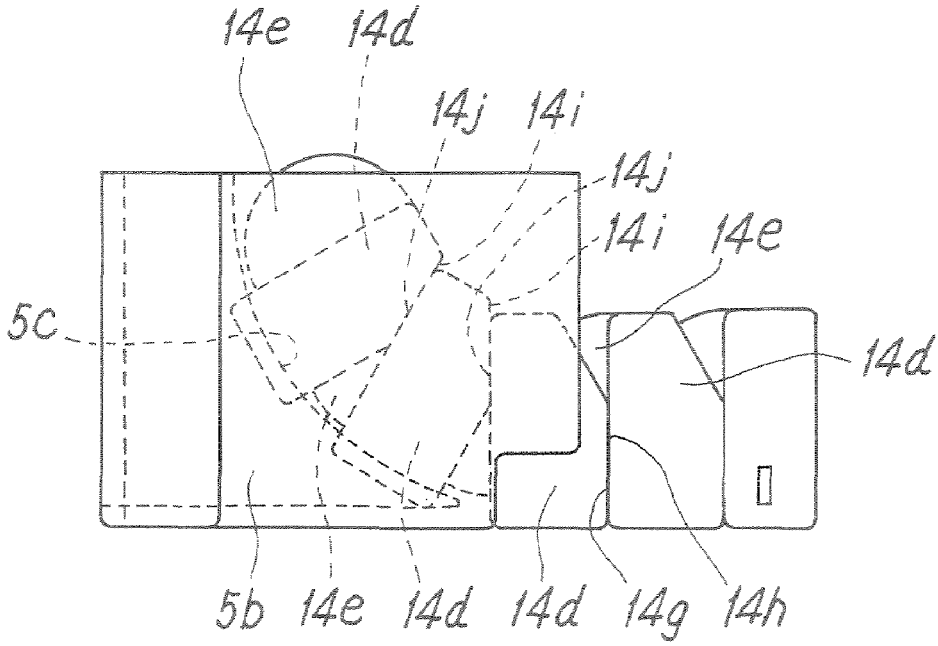
FIG. 10 It is a partial enlarged view conceptually showing a state in which the net guide for wire screen of the same is caused to go in and out to and from an inside of a movable frame.

Further, in both ends of the standing wall base part 14*d* in a connection direction, there are provided plane parts 14*g*, 14*h* as butt parts causing the adjoining guide pieces 14 to mutually butt under a state in which the net guide 12 is linearly introduced out from the movable frame 5 and, additionally as clearly shown in FIG. 10, there are provided plane parts 14*i*, 14*j* as butt parts causing the adjoining guide pieces 14 to mutually butt when the net guide 12 is bent in order to cause it to go in and out to and from the inside of the movable frame 5. Therefor, although the net guide 12 constituted by connecting the many guide pieces 14 can be bent upward concavely for a bent introduction-in-and-out to and from the movable frame 5, it is possible to suppress, by preventing the bending in a reverse direction, a disturbance of opening/closing operation due to a float from a floor face.

The plane part 14*g* is a plane part positioned in a side opposite to a protrusion side of the standing wall convex part 14*e* and becoming vertical under a state in which the net guide 12 is linearly introduced out, the plane part 14*i* is a plane part positioned above the plane part 14*g* and being slanted in a standing wall convex part 14*e* side, the plane part 14*h* is a plane part positioned in the standing wall convex part 14*e* side, parallel to the plane part 14*g* and having a height of the same degree as the plane part 14*g*, and the plane part 14*j* is a portion existing on the same plane as the plane part 14*h* and positioned above the plane part 14*h*.

Figure 7:
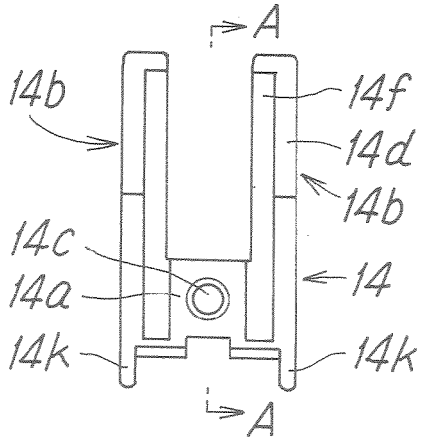
FIG. 7 It is a right side view of the same.
Figure 8:
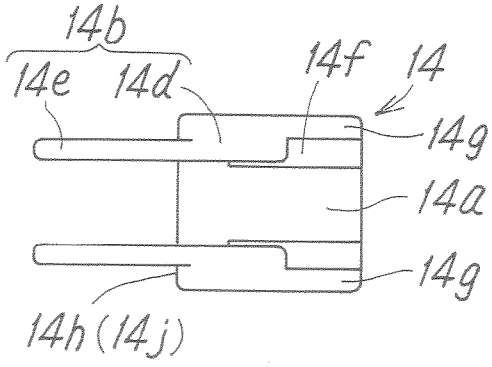
FIG. 8 It is a plan view of the same.
Figure 9:
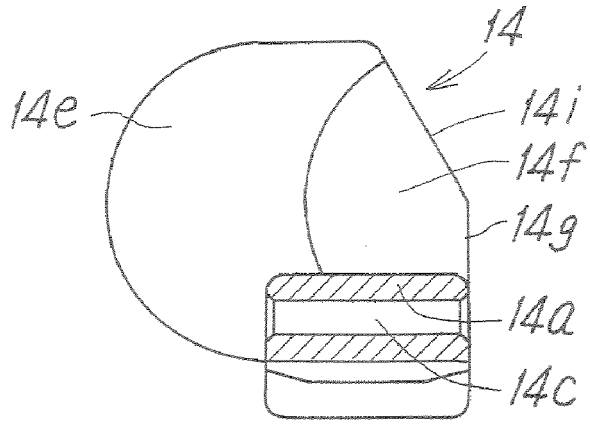
FIG. 9 It is a sectional view at an A-A position in FIG. 7.

Further, as shown in FIG. 7, the guide piece 14 makes guiding protrusions 14*k* by slightly hanging lower portions of the standing wall base parts 14*d* from both side ends of the bottom part 14*a*. As shown in FIG. 1 and FIG. 3, although the guiding protrusion 14*k* is one which, by fitting a rail-like guide part G protrusion on the floor face of the building opening part in a degree not becoming hindrance of walking, causes the net guide 12 to suitably slide on the guide part G to thereby make possible a stable opening/closing of the net 4 along the guide part G, it is not necessarily required to provide the guiding protrusion 14*k* and the guide part G on the floor face.

A shown in FIG. 4 and FIG. 5, in the net guide 12, although the respective guide pieces 14 are connected by inserting the wire 15 through the through-hole 14*c* of each of the guide pieces 14, in this wire 15 there is additionally provided a spring means 16 retaining the many guide pieces 14 in a linear connected state by spring-biasing the guide pieces 14 under the connected state in a direction mutually contacting closely.

This spring means 16 is one constituted by the facts that one end of the wire 15 is fixed to the guide piece 14 in one end side under the connected state by a fixation element 15*a*, the other end of the wire 15 is connected to one end of a coil spring 17, the coil spring 17 is accommodated in a hollow cylindrical accommodation tube 18 and the other end of the coil spring 17 is introduced out from a tip of the accommodation tube 18, and its introduced-out end is fixed to an outer end part of the accommodation tube 18 by a fixation element 15*b*. The hollow cylindrical accommodation tube 18 has a length sufficient to accommodate in its inside the coil spring 17 even when it is sufficiently stretched. Moreover, the coil spring 17 is mounted under a state giving a suitable tension to the wire 15 when its both ends are fixed to the guide piece 14 and an outer end part of the accommodation tube 18. Accordingly, a wire insertion end side of the accommodation tube 18 is pressure-contacted with an end part of the guide piece 14 under the connected state by the biasing force of the coil spring 17.

As shown in FIG. 1, in the net guide 12, there is made such that, the guide piece 14 in one end side under the connected state is connected to a lower end of the longitudinal frame member (fixed frame) 8, the accommodation tube 18 of the coil spring 17 butting against the guide piece 14 in the other end side under the connected state is disposed together with several guide pieces 14 in the movable frame 5, and when the movable frame 5 moves, they move up and down in the movable frame 5. Incidentally, it is possible to provide, in the frame cap 5*b* in a lower end part of the movable frame 5, a guide face 5*c* guiding the bend of the net guide 12 in compliance with a necessity.

In the net guide 12, since the many guide pieces 14 are connected by the wire 15 inserted through the through-holes 14*c* provided in the bottom parts 14*a* of these guide pieces 14 and the tension is given to the wire 15 by the spring means 16, the many guide pieces 14 can be connected in the connected state by the wire 15 caused to always have a constant tension, and it is possible to cause the connection of the guide pieces 14 to have the stretchability by the spring means 16.

And, since the net guide 12 for wire screen is caused to have the stretchability by the spring means 16, it is bendable when going in and out from the lower end of the movable frame 5 as shown in FIG. 1 and FIG. 5. Further, even in a case where the strong impact is exerted, e.g., by the fact that the foot is caught by the net guide 12 for wire screen, since that impact is absorbed by the spring means 16, it is possible to prevent the net guide 12 from being damaged and, moreover also after a deformation of the net guide 12, it can be returned to an original form by the biasing force of the coil spring 17.

FIG. 11 and FIG. 12-FIG. 14 are ones showing a second embodiment of the net guide for wire screen, which is concerned with the invention.

Figure 11:
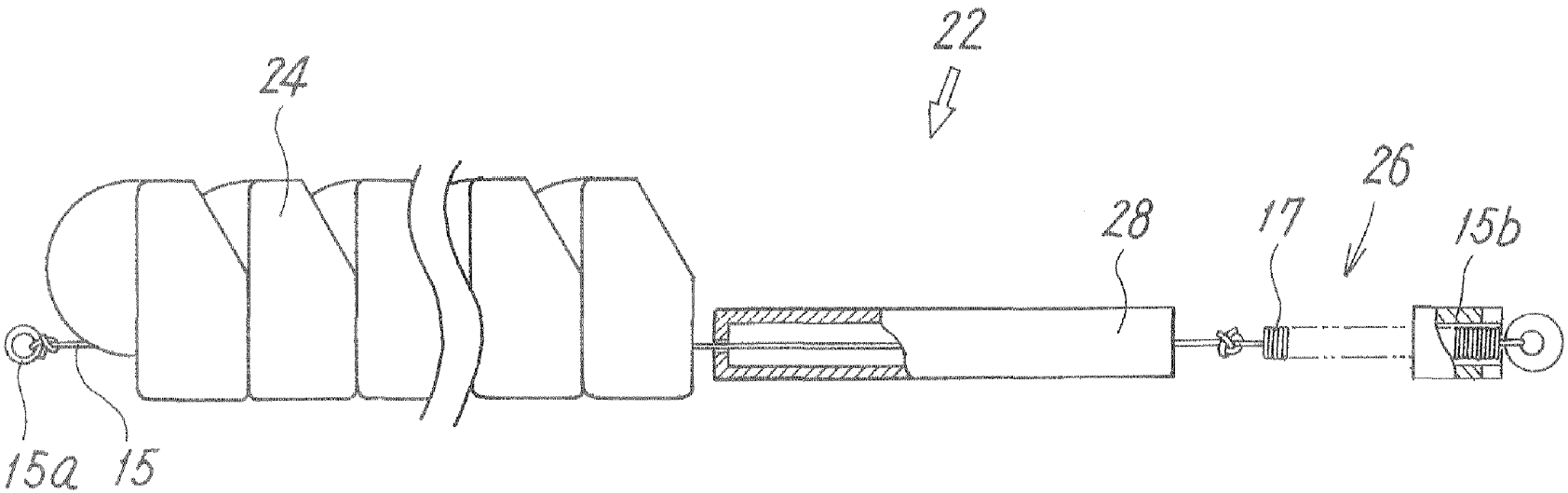
FIG. 11 It is a partially broken front view showing a second embodiment of the net guide or wire screen according to the invention.
Figure 12:
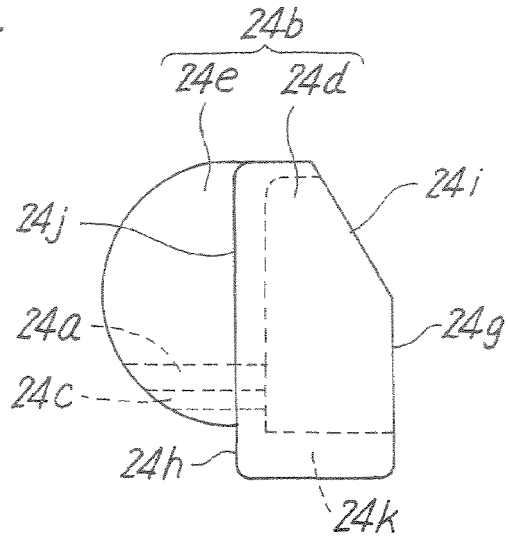
FIG. 12 It is a front view showing a constitution of a guide piece used in the net guide for wire screen of the same.
Figure 13:
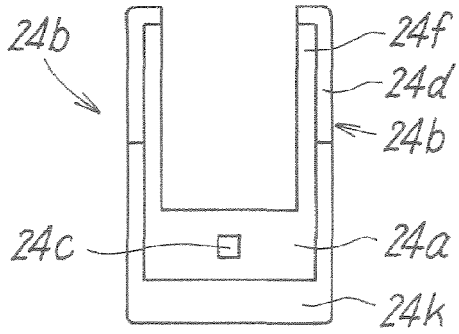
FIG. 13 It is a right side view of the same.
Figure 14:
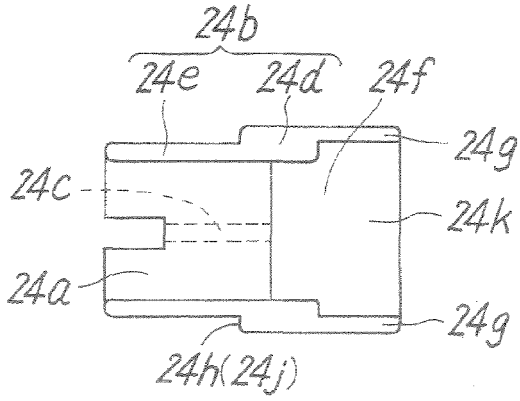
FIG. 14 It is a plan view of the same.

Although a net guide 22 for wire screen is similar in its main constitution to the net guide 12 for wire screen of the embodiment 1, a disposition of a spring means 26 is made reverse to the case of the first embodiment as shown in FIG. 11. Further, constitutions of a guide piece 24 and the spring means 26 differ from the guide piece 14 and the spring means 16 of the embodiment 1.

If mentioned more detailedly, the guide piece 24 is one formed approximately like the U-letter by a bottom part 24*a* along the lower end of the net 4 and one pair of standing wall parts 24*b* which stand up along the outer face of the net 4 and, in the bottom part 24*a* of this guide piece 24, there is provided a through-hole 24*c* for inserting the wire 15 in the direction along the lower end of the net 4. The standing wall part 24*b* is constituted by a standing wall base part 24*d* vertically standing up from both sides of the bottom part 24*a*, and a semicircular standing wall convex part 24*e* monolithically protruding from one side of the standing wall base part 24*d* and, in an inside wall of the standing wall base part 24*d*, there is provided an escape part 24*f* for accommodating the semicircular standing wall convex part 24*e* of the adjoining guide piece 24.

Further, in both ends of the standing wall base part 24*d* of an approximately rectangular shape in a connection direction, there are provided plane parts 24*g* and 24*h* as butt parts butting against the adjoining guide piece 24 under a state in which the net guide 22 is linearly introduced out, and there are provided plane parts 24*i*, 24*j* as butt parts butting against the adjoining guide piece 24 when the net guide 22 is bent in order to cause it to go in and out to and from the inside of the movable frame 5. Therefor, although the net guide 22 can be bent upward concavely for the bent introduction-in-and-out to and from the movable frame 5, it is possible to suppress, by preventing the bending in the reverse direction, the disturbance of opening/closing operation due to the float from the floor face.

As shown in FIG. 11, as the spring means 26, it is one constituted by the facts that one end of the wire 15 is fixed to the guide piece 24 in one end side under the connected state by the fixation element 15*a*, the other end of the wire 15 is connected to one end of the coil spring 17, the coil spring 17 is accommodated in a hollow cylindrical accommodation tube 28, and the other end of the coil spring 17 is fixed to an outer end part of the accommodation tube 18 by the fixation element 15*b*.

Incidentally, in FIG. 11, although the wire 15 is shown under its stretched state, it is mounted under a state in which a suitable tension is given to the wire 15 similarly to the embodiment shown in FIG. 4 and FIG. 5, and the guide pieces 24 are pressure-contacted by the biasing force of the coil spring 17. Further, since the constitution and the action other than those explained here in relation to the second embodiment do not change from the case of the first embodiment explained before, their explanations are omitted.

The net guide for wire screen of the invention is not one necessarily limited to the above embodiments. For example, in the above embodiments, although the winding shaft 30 is accommodated in the fixed frame constituting the longitudinal frame member 8 and the net guides 12, 22 are caused to go in and out to and from the inside of the movable frame 5 from its lower end, as mentioned before, the winding shaft may be accommodated in the movable frame, and the net guide may be caused to go in and out to and from the inside of the longitudinal frame member from its lower end.

Further, in the above embodiments, although the spring means 16, 26 of the net guides 12, 22 are constituted with the coil spring 17 to which the wire 15 is connected and the accommodation tubes 18, 28 accommodating the coil spring 17 being made main members, it is also possible to use a wire having the stretchability as the wire and, by it, constitute the spring means.

The invention claimed is:

1. A net guide for a wire screen, the net guide comprising:

a plurality of guide pieces, each of which comprises a bottom portion that forms a bottom face, a pair of parallel upright side walls that extend upward from the bottom portion and form side faces that face each other, and a generally U-shaped groove formed by the bottom face and side faces, the bottom portion of each of the guide pieces further comprises first and second end faces positioned on the sides of the bottom portion facing the groove, and a through-hole linearly passing through the bottom portion from the first end face to the second end face along the length of the groove;

an elastic wire that passes through the through-hole of each of the guide pieces to connect the guide pieces sequentially to one another, the guide pieces being movable with respect to the wire; and a spring positioned at an end of the wire and arranged coaxially therewith to exert an elastically compressive force in a direction of the guide pieces such that the first end face of the bottom portion of any one of the guide pieces is brought into pressure contact with the second end face of the bottom portion of an adjacent guide piece, wherein the net guide is flexible such that it can be bent.

2. The net guide for a wire screen according to claim 1, wherein the first and second end faces of the bottom portion of each of the guide pieces are formed as planar faces that are perpendicular to the groove in its lengthwise direction.

3. The net guide for a wire screen according to claim 2, wherein the through-hole of each of the guide pieces is a sole through-hole that passes through the bottom portion of each of the guide pieces, and a single piece of wire is inserted through the through-hole.

4. The net guide for a wire screen according to claim 1, wherein each of the upright parallel side walls comprises first and second end faces on the sides of each of the walls along the length of the groove, the first and second end faces are sloped at different angles relative to each other, and the first end face of each of the upright wall portions of any one of the guide pieces and the second end face of each of the upright wall portions of an adjacent guide piece contact each other when the net guide is bent.

5. The net guide for a wire screen according to claim 1, wherein the spring is a coil spring, and the coil spring is coaxial to the wire when the coil spring is extended.

6. The net guide for a wire screen according to claim 5, wherein the wire has first and seconds ends in a longitudinal direction, the coil spring has first and second ends in an axial direction, the net guide has a pressure contact member that contacts the guide piece that is positioned closest to the first end of the wire, the second end of the wire is fixed to the guide piece that is positioned closest to the second end of the wire, the first end of the coil spring is fixed to the first end of the wire when the coil spring is extended, and the second end of the coil spring is fixed to the pressure contact member.

7. The net guide for a wire screen according to claim 6, wherein the pressure contact member further comprises a hollow tube to contain the coil spring therein, the tube has an insertion end having an opening at one end thereof in an axial direction, the first end of the wire is inserted into the tube through the opening of the insertion end, and the insertion end of the tube contacts the guide piece that is positioned closest to the first end of the wire.

8. A wire screen apparatus comprising:

a net guide, the net guide comprising:

a plurality of guide pieces, each of which comprises a bottom portion that forms a bottom face, a pair of parallel upright side walls that extend upward from the bottom portion and form side faces that face each other, and a generally U-shaped groove formed by the bottom face and side faces, the bottom portion of each of the guide pieces further comprises first and second end faces positioned on the sides of the bottom portion facing the groove, and a through-hole linearly passing through the bottom portion from the first end face to the second end face along the length of the groove;

an elastic wire that passes through the through-hole of each of the guide pieces to connect the guide pieces sequentially to one another, the guide pieces being movable with respect to the wire; and a spring positioned at an end of the wire and arranged coaxially therewith to exert an elastically compressive force in a direction of the guide pieces such that the first end face of the bottom portion of any one of the guide pieces is brought into pressure contact with the second end face of the bottom portion of an adjacent guide piece, wherein the net guide is flexible such that it can be bent;

a net comprising first and second ends, the net expands and compresses in a horizontal direction; and first and second frame members attached, respectively, to first and second ends of the net, wherein at least one of the first and second frame members is a movable frame that slides in the horizontal direction, the first frame member further comprises an inner space extending in a vertical direction, and an opening leading to the inner space at a bottom end of the first frame member, and the net guide further comprises first and second ends that are respectively attached between the first and second frame members, wherein a first end of the net guide is fixed to a lower end of the second frame member, the grooves of the plurality of guide pieces open upwardly along a lower end of the net hung in an area between a lower end of the first frame member and a lower end of the second frame member, and a portion of the net guide including the second net guide end enters the inner space of the first frame member through the opening and moves vertically therein.

9. The wire screen apparatus according to claim 8, wherein the first and second end faces of the bottom portion of each of the guide pieces are formed as planar faces that are perpendicular to the groove in its lengthwise direction.

10. The wire screen apparatus according to claim 9, wherein the through-hole of each of the guide pieces is a sole through-hole that passes through the bottom portion of each of the guide pieces, and a single piece of wire is inserted through the through-hole.

11. The wire screen apparatus according to claim 10, wherein each of the upright parallel side walls of each of the guide pieces comprises first and second end faces on the sides of the walls along the length of the groove, the first and second end faces are sloped at different angles relative to each other, and the first end face of each of the upright wall portions of any one of the guide pieces and the second end face of each of the upright wall portions of an adjacent guide piece contact each other when the net guide is bent.

12. The wire screen apparatus according to claim 8, wherein the spring is a coil spring, and the coil spring is coaxial to the wire when the coil spring is extended.

13. The wire screen apparatus according to claim 12, wherein the wire has first and seconds ends in a longitudinal direction, the coil spring has first and second ends in an axial direction, the net guide has a pressure contact member that contacts the guide pieces that is positioned closest to the first end of the wire, the second end of the wire is fixed to the guide piece that is positioned closest to the second end of the wire, the first end of the coil spring is fixed to the first end of the wire when the coil spring is extended, and the second end of the coil spring is fixed to the pressure contact member.

14. The wire screen apparatus according to claim 13, wherein the pressure contact member further comprises a hollow tube to contain the coil spring therein, the tube has an insertion end having an opening at one end thereof in an axial direction, the first end of the wire is inserted into the tube through the opening of the insertion end, and the insertion end of the tube contacts the guide piece that is positioned closest to the first end of the wire.

15. The wire screen apparatus according to claim 13, wherein the first end of the wire is positioned at a side of the second end of the net guide, and the second end of the wire is positioned at a side of the first end of the net guide.

* * * * *